US009663286B2

(12) United States Patent
Schmertz, Jr.

(10) Patent No.: US 9,663,286 B2
(45) Date of Patent: May 30, 2017

(54) FITMENT AND CONTAINER FOR POWDERED PRODUCTS, ESPECIALLY POWDERED PRODUCTS PRONE TO CLUMPING BEHAVIOR

(71) Applicant: William Schmertz, Jr., Memphis, TN (US)

(72) Inventor: William Schmertz, Jr., Memphis, TN (US)

(73) Assignee: BAYER HEALTHCARE LLC, Whippany, NJ (US)

( * ) Notice: Subject to any disclaimer, the term of this patent is extended or adjusted under 35 U.S.C. 154(b) by 0 days.

(21) Appl. No.: 14/347,769

(22) PCT Filed: May 20, 2013

(86) PCT No.: PCT/US2013/041752

§ 371 (c)(1),
(2) Date: Mar. 27, 2014

(87) PCT Pub. No.: WO2013/177009

PCT Pub. Date: Nov. 28, 2013

(65) Prior Publication Data

US 2015/0041423 A1 Feb. 12, 2015

Related U.S. Application Data

(60) Provisional application No. 61/649,618, filed on May 21, 2012, provisional application No. 61/791,036, filed on Mar. 15, 2013.

(51) Int. Cl.
*B67D 3/00* (2006.01)
*B65D 83/06* (2006.01)
(Continued)

(52) U.S. Cl.
CPC ..... *B65D 83/06* (2013.01); *B65D 47/00* (2013.01); *B65D 47/043* (2013.01)

(58) Field of Classification Search
CPC .... A47G 19/24; B65D 83/06; B65D 47/0847; B65D 47/185; B65D 47/265
(Continued)

(56) References Cited

U.S. PATENT DOCUMENTS 843,280 A 2/1907 Kampfe
1,411,594 A 4/1922 Sweet
(Continued)

OTHER PUBLICATIONS

International Search Report and Written Opinion for PCT/US2013/041752 mailed on Oct. 4, 2013; 7 pages.

*Primary Examiner* — Shawn M Braden
(74) *Attorney, Agent, or Firm* — Yonggang Ji

(57) ABSTRACT

Fitment and container for powdered products, especially powdered products prone to clumping behavior, comprising a stopper that closes the passageway between the interior chamber and the mouth of the container, a pour spout in the stopper that permits the powdered product to flow through the passageway during a pouring operation, and one or more baffles connected to the stopper and extending into the interior chamber of the container, the baffles being configured to break apart clumps of the powdered product before the clumps can flow through the pour spout. The pour spout further includes a restriction element, associated with the pour spout, configured to break apart clumps that reach the pour spout without being broken apart by the baffles. The invention promotes a consistent and predictable rate of flow in the stream of powdered product flowing out of the container during the pouring operation.

12 Claims, 9 Drawing Sheets

(51) Int. Cl.
*B65D 47/04* (2006.01)
*B65D 47/00* (2006.01)

(58) Field of Classification Search
USPC ..... 222/480, 547, 564, 565
See application file for complete search history.

(56) References Cited

U.S. PATENT DOCUMENTS

| | | | | | |
|---|---|---|---|---|---|
| 2,173,542 | A | | 9/1939 | Simington | |
| 2,530,730 | A | * | 11/1950 | Richter | 222/427 |
| 2,921,724 | A | | 1/1960 | Whitney | |
| 3,151,781 | A | * | 10/1964 | McKee | 222/189.02 |
| 3,424,351 | A | * | 1/1969 | Rusak, Jr. et al. | 222/189.02 |
| 3,773,232 | A | * | 11/1973 | Hidding | 222/480 |
| 6,364,169 | B1 | * | 4/2002 | Knickerbocker | 222/189.02 |
| 2007/0007310 | A1 | * | 1/2007 | Antal, Sr. | B65D 47/046 222/480 |
| 2007/0145082 | A1 | * | 6/2007 | Parve | 222/480 |

* cited by examiner

FITMENT AND CONTAINER FOR POWDERED PRODUCTS, ESPECIALLY POWDERED PRODUCTS PRONE TO CLUMPING BEHAVIOR

PRIORITY CLAIM

This application is a §371 National Stage Application of PCT/US2013/041752, filed on May 20, 2013, which claims priority from U.S. Provisional Application Ser. No. 61/791,036, filed on Mar. 15, 2013 and U.S. Provisional Application Ser. No. 61/649,618, filed on May 21, 2012.

FIELD OF ART

The invention relates to containers and dispensers for powdered or granulated products and substances, especially powdered or granulated products and substances prone to clumping behavior. More particularly, the invention is directed to a fitment and container configured to promote pouring the powdered or granulated products from the container in a stream having a consistent and predictable rate of flow, despite the presence of clumps of the powdered or granulated product in the container.

BACKGROUND OF THE INVENTION

Certain powdered and granulated materials, including some pharmaceutical products, are susceptible to irregularly-shaped and randomly-sized clumps (or clusters) forming therein as a result of coming into contact with moisture while the powdered products are being used, stored or transported. The moisture may enter the container by gradual diffusion through microscopic gaps in the walls and seals of the containers, and/or may be trapped inside the containers when the containers are originally filled and sealed. When a user tilts the container at an angle in order to pour some of the powdered or granulated product out of the mouth of the container and into a dosing or measuring device, such as a measuring cup or spoon, the tilting action causes a stream of powdered or granulated product to flow out of the mouth of the storage or transport container and into the dosing or measuring device. As would be natural for such a pouring operation, the user will typically watch and observe the size, angle and shape of the stream, along with the level of powdered or granulated product already present in the dosing or measuring device, in order to judge the apparent flow rate of the powdered or granulated product exiting the tilted container and to estimate whether and when to adjust the angle of tilt on the container in order to avoid spilling and wasting the product and/or over- and under-filling the dosing or measuring device. If the powdered or granulated product is a medication, over- or under-filling the dosing or measuring device could lead to over- or under-dosing the medication, which could have severe consequences for medical patients.

When the stream of powdered or granulated product flowing from the mouth of the container contains irregularly-shaped and randomly-sized clumps, however, the clumps tend to cause random and unpredictable changes in the size, angle and shape of the stream as it exits the mouth of the container. Moreover, as the stream of powdered or granulated product passes out of the mouth of the container, the clumps can come into contact with the interior surfaces of the mouth of the container just before exiting the container, which may cause some of the clumps to get caught on the interior surfaces and temporarily obstruct or restrict the rate at which the stream flows out of the mouth of the container. In addition, some of the clumps in the stream may collide with other clumps in the stream just as the clumps are exiting the container. The collisions may cause some of the clumps to break apart as they exit the container, further changing the size, angle and shape of the stream in random and unpredictable ways.

Thus, it has been observed that when a powdered or granulated product is poured from a container in a stream, the presence of irregularly-shaped and randomly-sized clumps in the stream, combined with the random catching, releasing, colliding and/or breaking apart of the clumps just as the clumps are exiting the mouth of the container, causes random and unpredictable variations in the size, angle and shape of the stream so that it becomes very difficult for the user to properly judge the rate of flow for the stream, and very difficult to estimate when the angle of tilt for the container should be increased or reduced so as to avoid under- or over-filling the dosing or measuring device.

DISCLOSURE OF THE INVENTION

In general, embodiments of the present invention provide a container fitment, or a container, such as a bottle, can, box, carton, or dispenser, for a powdered or granulated product, which is configured to break apart irregularly-shaped and randomly-sized clumps of the powdered product before the clumps can flow through the pour spout and pass out of the mouth of the container, thereby tending to promote a constant and well-defined stream of product as it exits the mouth of the container, as well as a consistent and predictable rate of flow in the stream during pouring. The constant, well-defined stream and the consistent and predictable flow rate of the stream permits the user to more easily judge when to change the angle of the container during the pouring operation, and thereby avoid unnecessary and wasteful spills.

According to one aspect of the invention, there is provided a fitment for a container of powdered product prone to clumping behavior, comprising a stopper, a pour spout, a restriction associated with the pour spout and a baffle. The stopper is configured to be interposed or lodged in the passageway (i.e., the neck or throat of the bottle) between the mouth of the container and interior chamber, thereby closing off the passageway to the flow of powdered product until the pour spout in the stopper is opened or unsealed prior to performing a pouring operation. The pour spout in the stopper extends entirely through the stopper so that, when the pour spout is open and the container is tilted to perform a pouring operation, the pour spout permits a portion of the powdered product in the interior chamber of the container to flow through the pour spout—and therefore through the passageway—and then out of the mouth of the container in a stream. One or more baffles are connected to the stopper, the baffles extending toward the interior chamber of the container and arranged to project into and penetrate the portion of the powdered product moving into the passageway made passable by the open pour spout. Thus, the baffles are arranged to lie in the path of some of the powdered product moving into the passageway, which causes some of the particles in the portion of powdered product flowing into the passageway to flow over and around the distal ends of the baffles. If there are any clumps of powdered product in the portion of powdered product flowing over and around the distal ends of the baffles, these clumps are likely to be broken apart by the baffles before the clumps can reach the pour spout and flow out of the mouth of the container.

Preferably, the stopper, the pour spout, or both the stopper and the pour spout, will comprise one or more restrictions configured to limit the volume of powdered product permitted to flow through the pour spout. Such restrictions may comprise, for example, a flange, filament, edge or finger in the stopper or the pour spout, which is arranged to make contact with and potentially filter and impede some part of the volume of powdered product flowing through the pour spout, whereby one or more clumps of powdered product in the volume of powdered product permitted to flow through the pour spout will be broken apart by contact with the restriction before flowing out of the mouth of the container. Thus, the restriction tends to break apart clumps of the powdered product that were not broken apart by the baffles as those clumps flowed past the baffles and into the pour spout.

The pour spout may comprise, for example, an asymmetric opening extending through a section of the stopper off the longitudinal axis of the stopper, a circular opening having a center axis that substantially coincides with the longitudinal axis of the stopper, a plurality of parallel openings extending through the stopper, or any one of any number of other apertures or voids suitable permitting powdered product to flow through the passageway connecting the interior chamber of the container to the mouth of the container.

Any number of baffles can be used in a variety of different sizes and orientations, so long as the baffles are arranged, relative to the pour spout, to increase the likelihood that the baffles will come into contact with the portion of powdered product moving toward and through the passageway during a pouring operation. Thus, a plurality of baffles may be connected to the stopper, the plurality of baffles extending toward the interior chamber of the container and arranged to penetrate the portion of powdered product, whereby, upon contact with one or more of the plurality of baffles, one or more of the clumps of powdered product in the portion of powdered product flowing into the passageway will be broken apart by one of more of the plurality of baffles. The plurality of baffles may be configured to run parallel to each other, not parallel to each other, or arranged to converge toward a single point on the stopper. The plurality of baffles may also be arranged to surround the pour spout extending through the stopper.

In another implementation of the present invention, there is provided a container for a powdered product prone to clumping behavior, the container comprising an interior chamber, a mouth, a passageway between the interior chamber and the mouth, a pour spout and one or more baffles attached to the stopper and extending into the passageway. The stopper is configured to be interposed in the passageway between the interior chamber of the container so as to impede the flow of powdered product from the interior chamber to the mouth. The pour spout extends through the stopper and, when the container is tilted for a pouring operation, permits a portion of the powdered product in the interior chamber to flow through the passageway and out of the mouth of the container in a stream. Because the powdered product is prone to clumping behavior, it is likely that the portion of powdered product moving toward and flowing into the passageway as a result of tilting the container will have one or more clumps. Accordingly, the baffles are attached to the stopper, or, alternatively, to the interior walls of the passageway, so that the baffles will project into and penetrate the portion of powdered product moving through the passageway during the pouring operation.

Upon contact with the baffle, a number of the clumps in the portion of powdered product flowing into the passageway will be broken apart before they can reach the pour spout and pass out of the mouth of the container. In preferred embodiments, a restriction is provided in the pour spout, the passageway or the stopper, which is configured to come into contact with and limit the volume of powdered product that can flow through the pour spout. Upon contact with the restriction, at least some of the clumps of powdered product that succeed in flowing past the baffles without being broken apart will be broken apart upon contact with the restriction. Thus, the containers of the present invention may be configured and arranged to provide two separate mechanisms for breaking apart clumps during a pouring operation, thereby promoting the desired consistent rate of flow for the stream of powdered product exiting the container. Although some small clumps in the powdered product may succeed in passing through the pour spout without being broken apart by the baffle or the restriction, such small clumps are typically not large enough to create an inconsistent rate of flow in the stream of powdered product exiting the container.

BRIEF DESCRIPTION OF THE FIGURES

The present invention and various aspects, features and advantages thereof are explained in detail below with reference to exemplary and therefore non-limiting embodiments and with the aid of the drawings, which constitute a part of this specification and include depictions of the exemplary embodiments. In these drawings.

DETAILED DESCRIPTION OF THE INVENTION

Figure 1A:
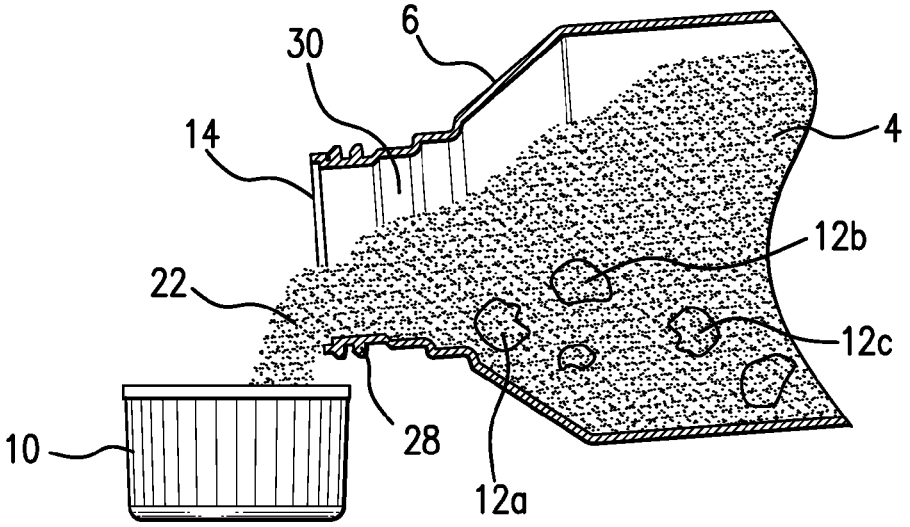
FIG. 1A PRIOR ART
FIGS. 1A-1D illustrate, by way of example, some of the problems associated with pouring powdered or granulated products prone to clumping behavior out of conventional containers.
Figure 1B:
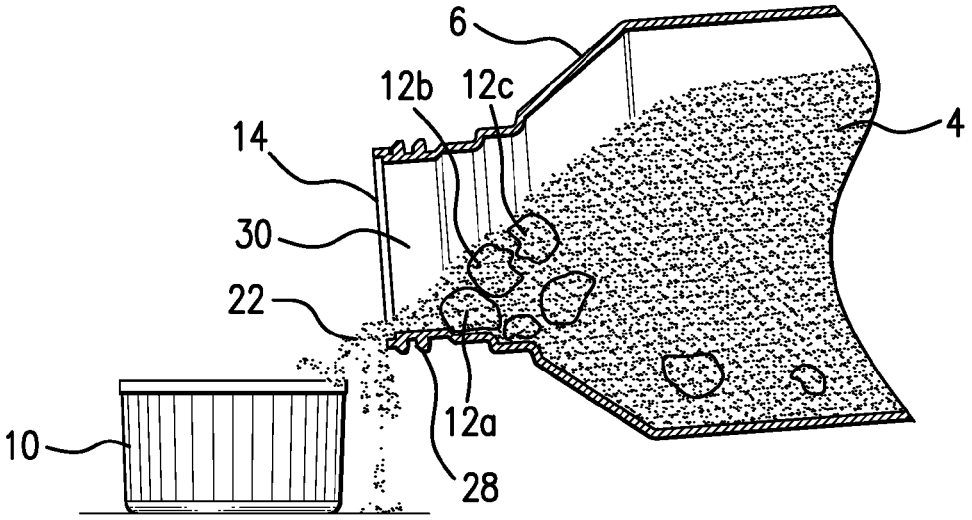
FIG. 1B PRIOR ART

FIGS. 1A, 1B, 1C and 1D contain illustrations that together show, by way of example, how a powdered product 4 tends to exit container 6 in a stream 22 having an inconsistent and unpredictable rate of flow as the product 4 is poured from the container 6 into a dosing or measuring device 10, such as a measuring spoon or cup. As shown FIG. 1A, when the container 6, filled with a powdered product 4, is lifted and tilted so as to pour the powdered product 4 out of the mouth 14 of container 6 and into the dosing or measuring device 10, the powdered product 4 may initially exit the container 6 in a stream 22 having a well-defined geometry associated with a consistent and predictable flow rate. So long as the throat 30 of the container 6 is not jammed with clumps 12*a*, 12*b* and 12*c* (as shown in FIG. 1B), the user is usually able to pour the powdered product 4 out of the container and into the dosing or measuring device 10 at a flow rate that is optimal for filling the dosing or measuring device 10. This permits the user to fill the dosing or measuring device 10 to a predetermined level substantially without spilling or wasting the powdered product 4.

As shown in FIG. 1B, however, when previously-formed clumps 12*a*, 12*b* and 12*c* of the powdered product 4 enter the throat 30 of the container 6, the clumps 12*a*, 12*b* and 12*c* can become temporarily lodged at the throat 30 or at lip 28 of the container, temporarily obstructing the flow of powdered product 4 out of the mouth 14, and thereby disrupting, reducing and/or preventing the consistent rate of flow for stream 22. Disruption and reduction in the flow rate of stream 22 exiting the mouth 14 of the container 6 may cause the stream 22 to undershoot and fall short of the dosing or measuring device 10, causing a significant amount of product 4 to land outside the measuring device 10.

Figure 1C:
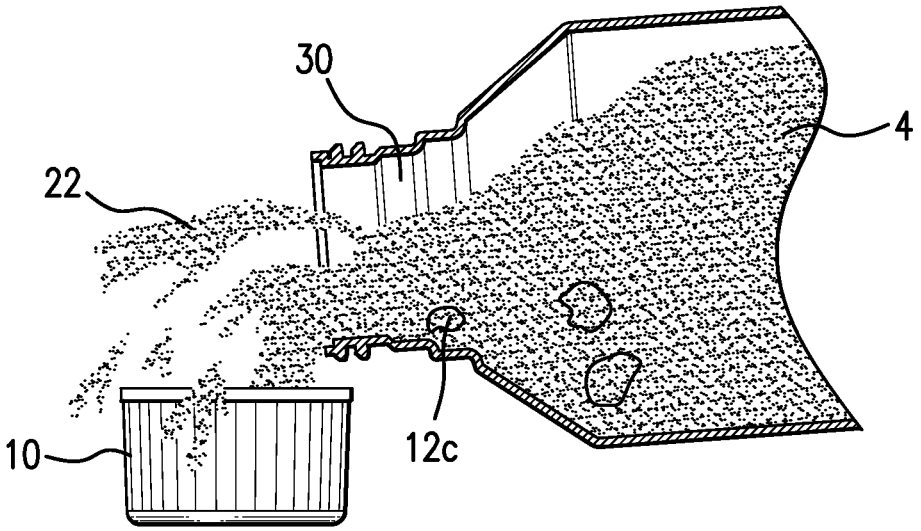
FIG. 1C PRIOR ART

If the individual performing the pouring operation sees the product 4 falling short of the dosing or measuring device, and does not understand that one or more clumps are obstructing the mouth 14, then he or she is likely to think it is appropriate and necessary to increase the pouring angle of the container 6, or, even worse, begin to shake the container 6, in an effort to increase the flow rate of stream 22 and re-acquire the flow rate that was determined to be optimal for pouring the powdered product 4 into the dosing or measuring device 10. This action of shaking the container 6 or increasing the tilting angle of the container 6 will increase both the velocity at which the clumps 12*a*, 12*b* and 12*c* strike the interior surfaces of the throat 30, as well as the effective weight of the product 4 behind and pushing against the clumps 12*a*, 12*b* and 12*c*, which may reduce the time required to break up the clumps 12*a*, 12*b* and 12*c* and/or force the clumps through the mouth 14. The instant that the clumps 12*a*, 12*b* and 12*c* strike the interior surfaces of the throat 30 or the lip 28 of the container 6, however, the loose bonds holding the clumps 12*a*, 12*b* and 12*c* together can suddenly give way, thereby causing the clumps 12*a*, 12*b* and 12*c* to suddenly break apart, suddenly and forcefully releasing the powdered product 4 in the clumps 12*a*, 12*b* and 12*c*, just as the clumps 12*a*, 12*b* and 12*c* are passing over the lip 28 through the mouth 14. The sudden release of the product 4 comprising the clumps 12*a*, 12*b* and 12*c* causes a sudden increase in the amount of product 4 passing out of the mouth 14 of the container 6, and a sudden change in the angle, size and geometry of the stream 22, which is likely to be unexpected by the individual performing the pouring operation. This sudden and unexpected change in the rate of flow, size and geometry of the stream 22 exiting the container 6 through the mouth 14 could cause the stream 22 exiting the container 6 to overshoot the dosage and measuring device 10, as illustrated in FIG. 1C.

Figure 1D:
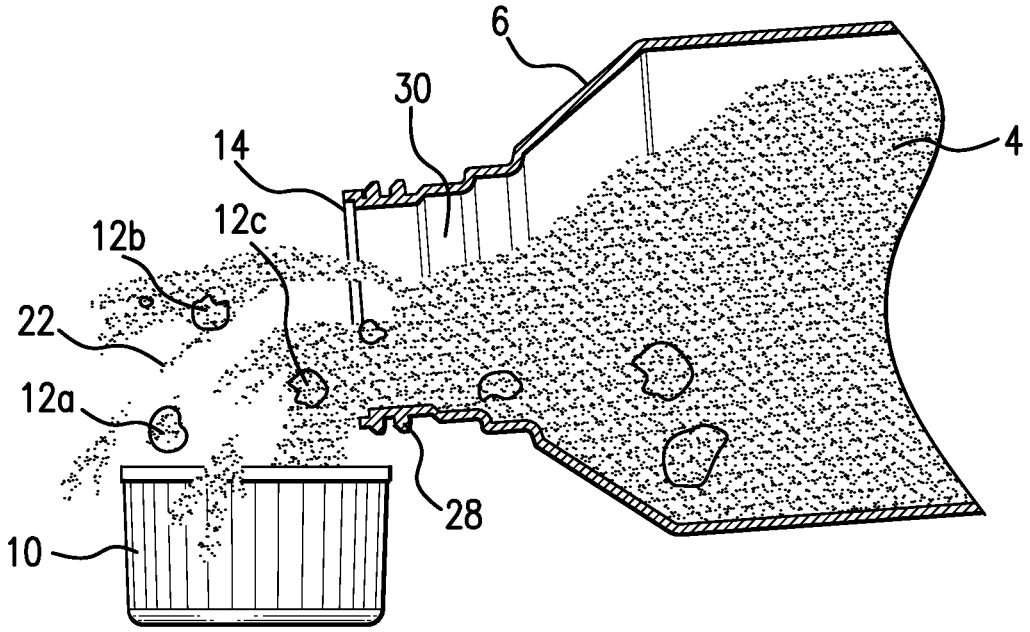
FIG. 1D PRIOR ART
Figure 2A:
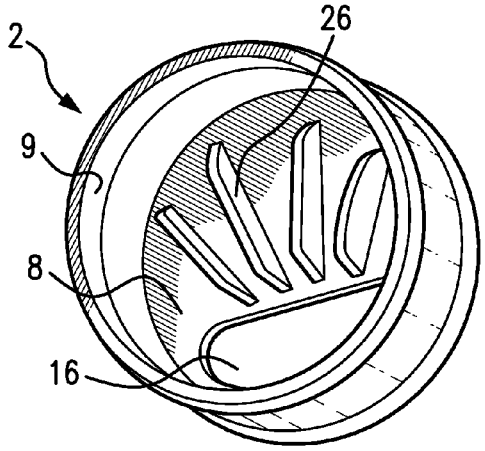
FIGS. 2A-2F depict a number of different implementations and views of exemplary fitments for a container for a powdered or granulated product, according to one aspect of the present invention.
Figure 2B:
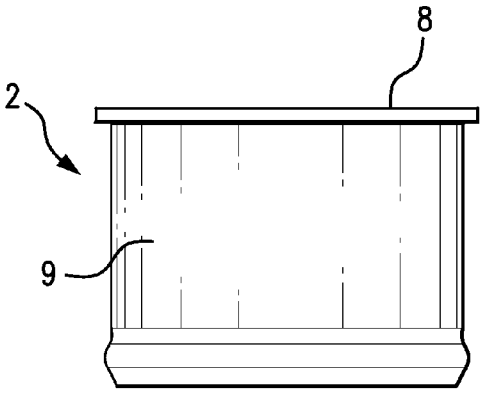
Figure 2C:
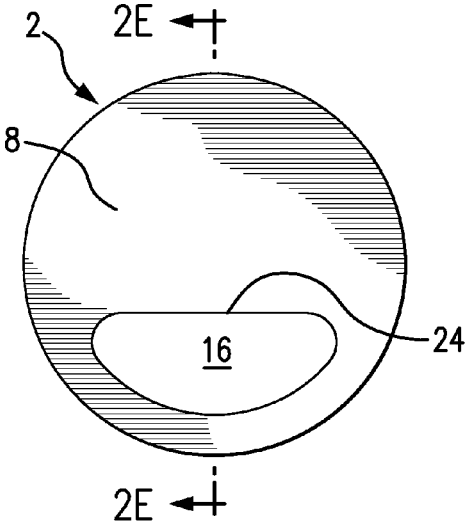
Figure 2E:
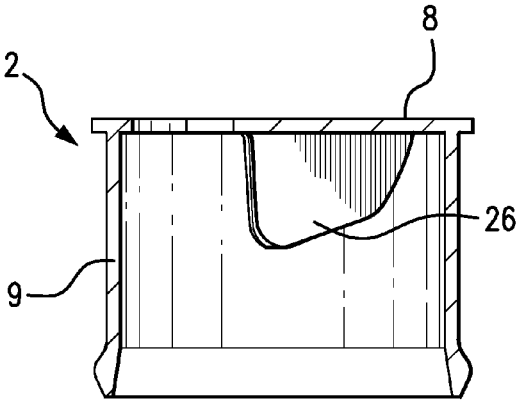
Figure 2D:
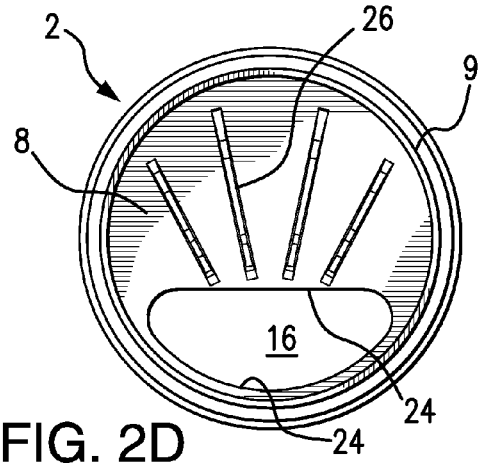
Figure 2F:
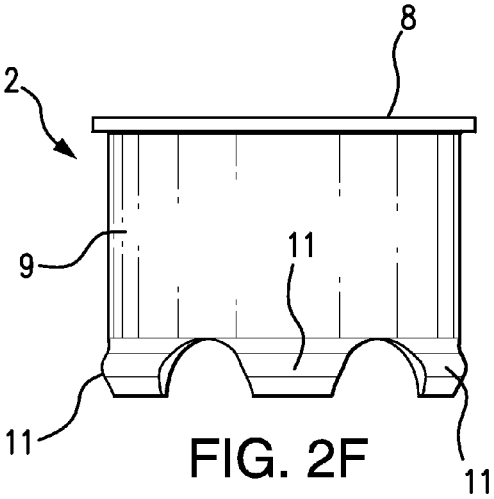

Even if the clumps 12*a*, 12*b* and 12*c* pass through the mouth 14 of the container 6 without striking the interior surfaces of the throat 30 or the lip 28 of the container 6, the presence of the clumps 12*a*, 12*b* and 12*c* in the stream 22 can still cause random and unpredictable changes in the cross-section and geometry of the stream 22, as illustrated in FIG. 1D, which makes it much more difficult for the user to judge and achieve the best angle of tilt to control the rate of flow for stream 22 and much more difficult to determine when to stop pouring. Thus, the inconsistent and unpredictably-changing stream 22 shown in FIGS. 1B, 1C and 1D, resulting from the presence and actions of the clumps 12*a*, 12*b* and 12*c* as they move through the throat 30 of the container 6, not only is likely to increase waste, but also results in an extremely negative experience for users during the pouring operation.

FIGS. 2A-2F show a fitment 2 for a container for a powdered or granulated product according to one exemplary embodiment of the present invention. As shown best in FIGS. 2A and 2D, the fitment 2 comprises a stopper 8, a pour spout 16 comprising an aperture or void extending all the way through the stopper 8, and a plurality of baffles 26 extending from the bottom surface of the stopper 8 substantially perpendicular to the plane of stopper 8. It is noted, however, that the baffles 26 do not necessarily have to be substantially perpendicular to the plane of the stopper 8. A variety of different angles, orientations and sizes may be used for the baffles 26, without departing from the scope of the present invention. As shown in FIGS. 2A-2E, the fitment 2 may also comprise a sidewall 9, also extending from the bottom surface of the stopper 8, configured to help secure the fitment 2 inside an elongated throat of a suitable container, as will be described in more detail below.

Figure 3A:
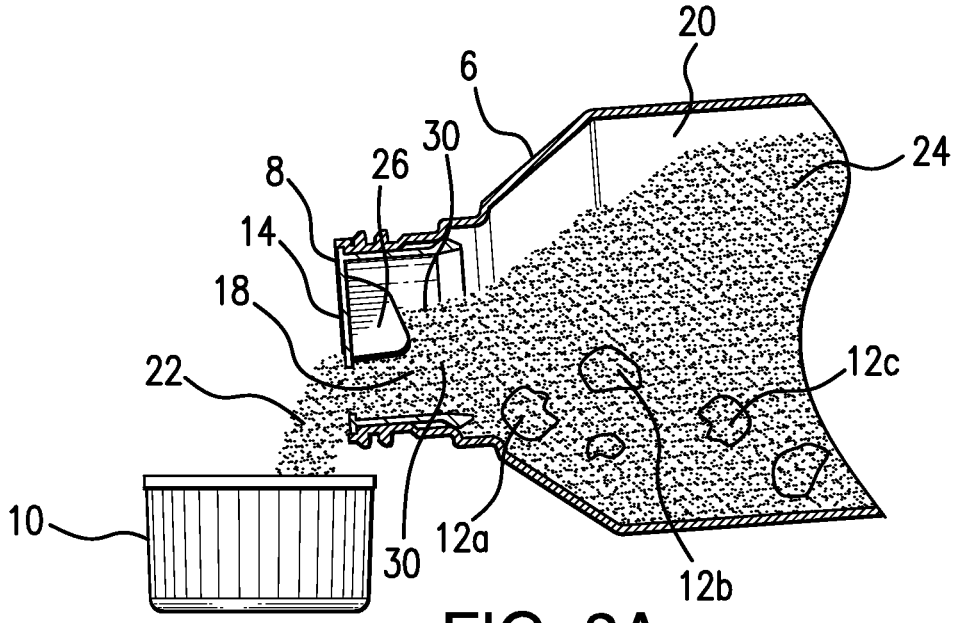
FIGS. 3A-3D show the fitments depicted in FIGS. 2A, 2B, 2C and 2B integrated into a container to illustrate, by way of example, some of the benefits and advantages associated with embodiments of the presently-claimed invention.
Figure 3B:
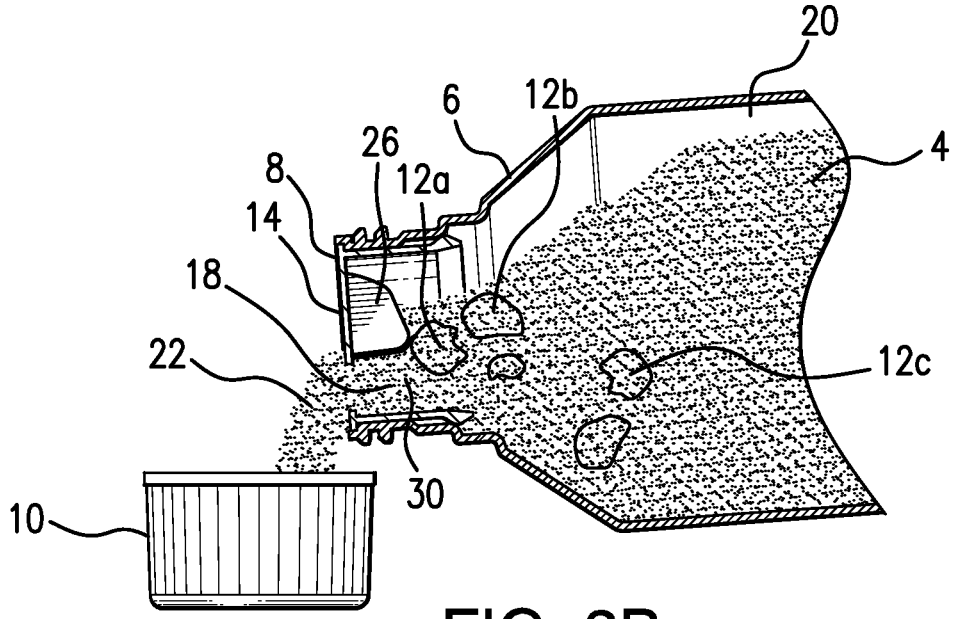
Figure 3C:
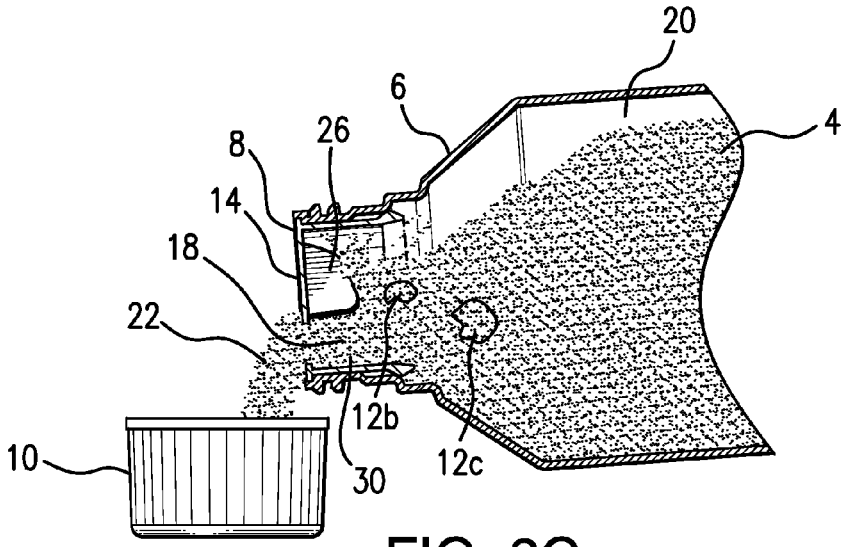

As shown in FIGS. 3A-3C, the stopper 8 is configured to be fixedly secured over the mouth 14 or inside the throat 30 of the container 6 so as to substantially close down the passageway 18 to the flow of powdered product 4 out of the mouth 14 of the container 6. The passageway 18 comprises the flow path along which the powdered product 4 moves from the interior chamber 20 to the mouth 14 of the container 6. In some embodiments, for example, the passageway 18 comprises an elongated throat 30 in the container 6, which separates the interior chamber 20 from the mouth 14 of the container 6. Where there is no elongated throat between the interior chamber 20 and the mouth 14 of the bottle, however, it is understood that the passageway 18 may be represented by the portion of the interior chamber 20, immediately adjacent to the inside of the mouth 14 of the container 6, which comprises at least part of the path along which the powdered product 4 must travel in order to flow out of the mouth 14 of the container 6.

FIGS. 3A-3C show the fitment 2 integrated into a container 6 in an example of one of the arrangements as contemplated herein. As shown in FIGS. 3A-3C, when the fitment 2 is in place on the container 6, the plurality of baffles 26 extend from the bottom surface of the stopper 8 toward the interior chamber 20 of the container 6. As the container 6 is tilted during the pouring operation, a portion of the powdered product 4, and any clumps 12*a*-12*c* in the portion of powdered product 4, are pulled by gravity toward the passageway 18, the pour spout 16 and the stopper 8, and some of the portion of powdered product 4 will begin to flow through the pour spout 16 and exit the mouth 14 of the container 6 in a stream 22. Baffles 26 are configured to penetrate the portion of the powdered product 4 moving toward the passageway 18 and the pour spout 16 during this pouring operation and to proactively break apart at least some of the clumps 12*a*, 12*b* and 12*c* in the portion of the powdered product 4 before the clumps 12*a*-12*c* can reach, block or impede the pour spout 16 or change the rate of flow and geometry of the stream 22.

Figure 3D:
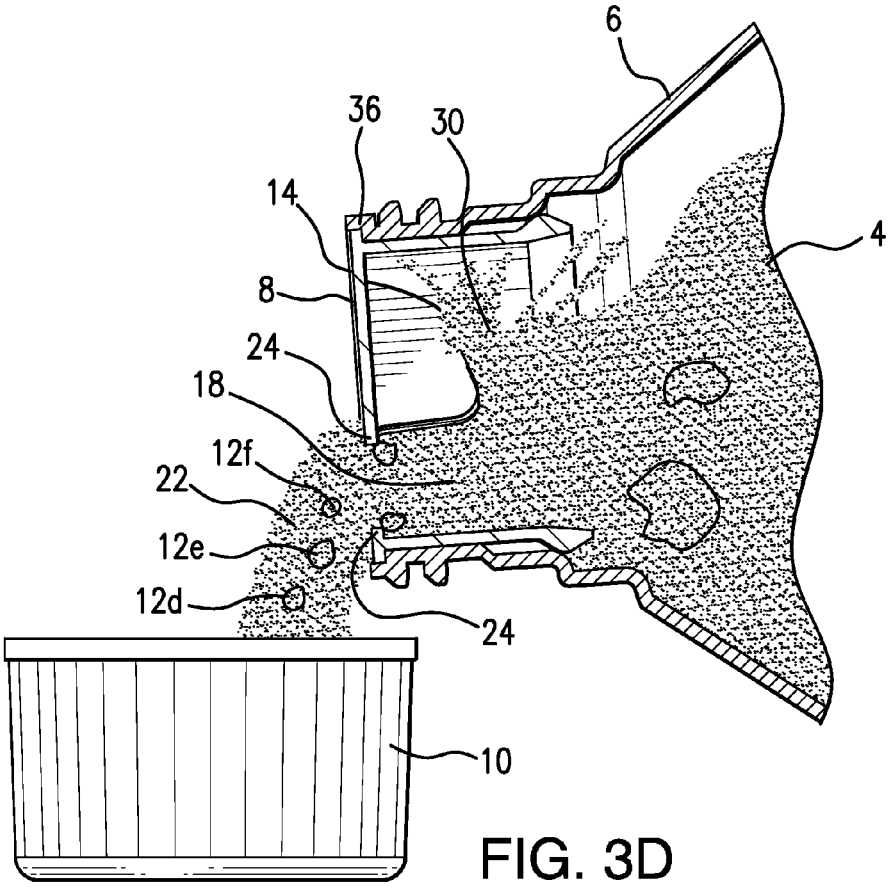
Figure 4A:
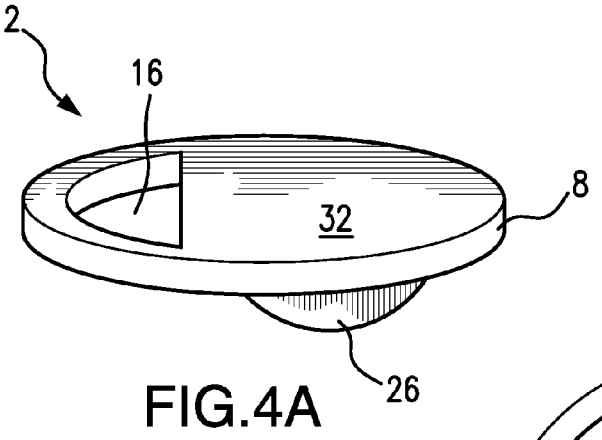
FIGS. 4A-4D show various views of an example of a fitment according to an alternative embodiment of the present invention, wherein the fitment includes a single baffle.
Figure 4B:
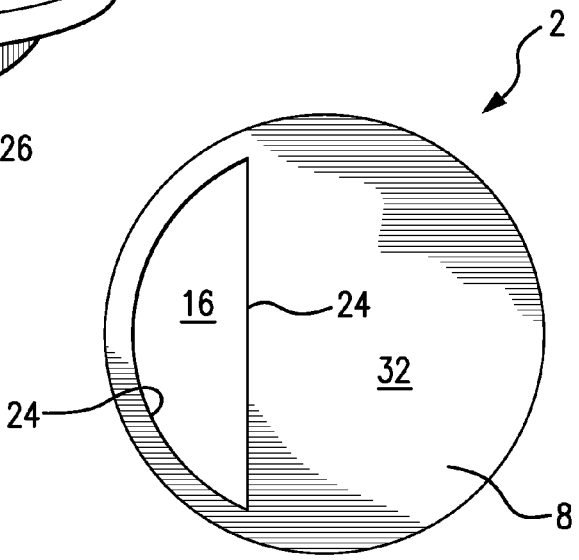
Figure 4C:
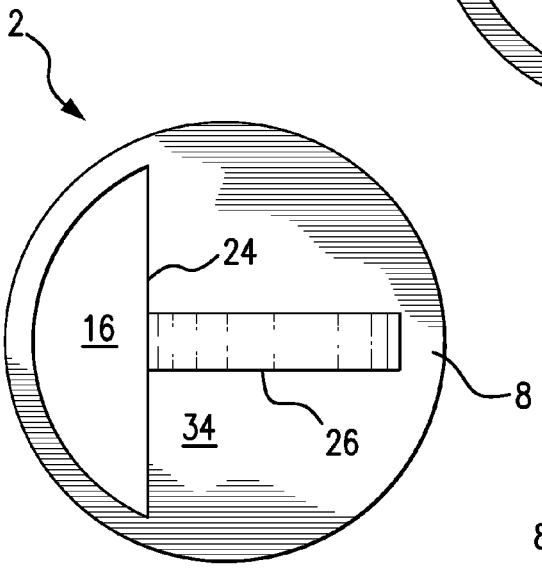
Figure 4D:
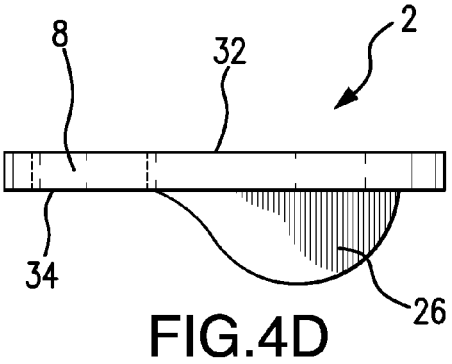
Figure 5A:
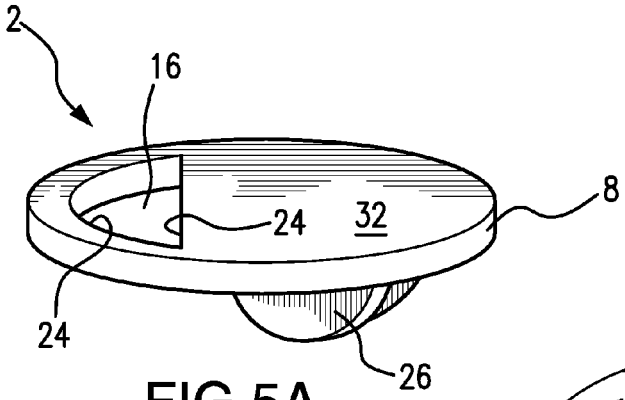
FIGS. 5A-5D show various views of an example of a fitment according to an alternative embodiment of the present invention, wherein the fitment includes three baffles oriented to converge toward a single point adjacent to the pour spout.
Figure 5B:
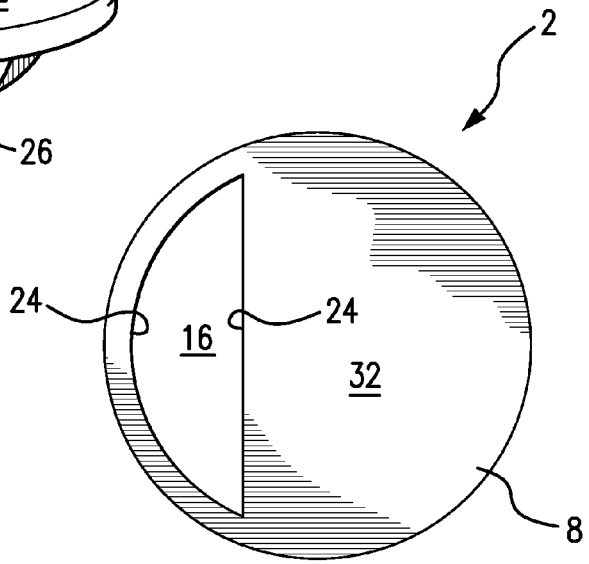
Figure 5C:
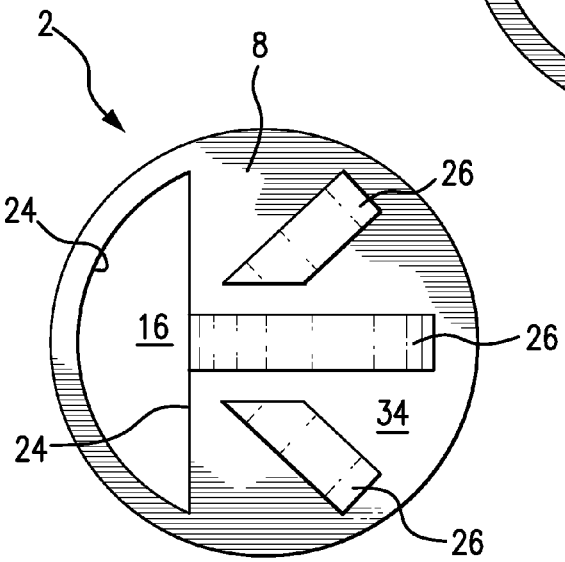
Figure 5D:
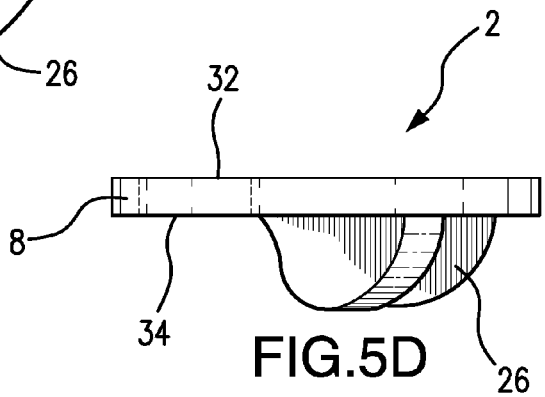

In some embodiments, the rim or edge surrounding the aperture comprising the pour spout 16 acts as a restriction 24 configured to limit the volume of powdered product 4 permitted to flow through the pour spout 16. Thus, like the baffles extending into the interior chamber 20, the restriction 24 surrounding the pour spout 16 is optionally configured to extend into the path of the portion of powdered product flowing through the pour spout and, consequently, partially obstruct the flow of powdered product 4 through the pour spout 16. As illustrated in FIG. 3D, if the powdered product 4 in the container 6 contains any clumps 12*d*, 12*e* and 12*f* that are large enough to change or disrupt the consistent flow rate of the stream 22 exiting the mouth 14 of the container 6 during the pouring operation, and these large clumps 12*d*, 12*e* and 12*f* manage to reach the pour spout 16 without being broken up by the baffles 26, then such relatively large clumps 12*d*, 12*e* and 12*f* will be broken apart by contact with the restriction 24 of the pour spout 16 in the stopper 8. This is because the restriction 24 sufficiently reduces the size of the pour spout 16 in the stopper 8, as compared to the expected sizes of the clumps 12*a*-12*f*, so that any clumps 12*d*-12*f* that are small enough to pass through the pour spout 16 without striking and breaking apart on the restriction 24 of the pour spout 16 will not substantially modify the size, angle, shape or other geometry of the smooth and consistent stream 22 flowing out of the mouth 14 of the container 6 through the pour spout 16. Thus, the baffles 26, the restriction 24 and the pour spout 16 all cooperate to break apart substantially all of the clumps 12*a*-12*f* that may be large enough to disrupt or change the geometry of stream 22 as it flows through the mouth 14 of the container 6, while permitting smaller clumps 12*d*-12*f* to pass out of the container 6 through the pour spout 16 without being broken apart. The overall effect of the action of the baffles 26, the restriction 24 and the pour spout 16 is to promote and assist in creating a stream 22 with a smooth and consistent size, angle, shape and rate of flow as it exits the mouth 14 of the container 6.

The fitment 2 can be attached to the container 6 by sealing the fitment 2 over the mouth 14 of container 6 by pressure fitting, heat sealing or adhesive, for example. Alternatively, if the container 6 has an elongated section, i.e., a throat 30, leading to the mouth 14, then the fitment 2 can be configured to remain securely lodged inside the throat 30 of the container 6 by virtue of opposing forces, such as one or more equally-spaced scallops 11 (illustrated in FIG. 2F) in the sidewall 9 of the fitment 2, which bias the fitment 2 in a downward direction, and one or more shelves 36 in the throat 30 of the container 6, which bias the fitment 2 in an upward direction. See FIGS. 2F and 3D, respectively, showing the scallops 11 and the shelf 36.

FIGS. 4, 5 and 6 illustrate, by way of example, alternative embodiments of the present invention. As shown in FIGS. 4A-4D, the fitment 2 comprises a disk-shaped stopper 8 having top and bottom surfaces, the top surface 32 forming a cover over the mouth 14 of the container 6 and the bottom surface 34 oriented towards the interior of the container 6 when the fitment 2 is integrated into the throat 30 of the container 6. The stopper 8 further comprises at least one pour spout 16 that extends from the top surface 32 through to the bottom surface 34. In certain embodiments, the pour spout 16 can be irregularly shaped, such as comprising curved portions and straight portions, or can be more regularly shaped, for example as a circle, half-circle, sphere, oval, ellipse, diamond, triangle, or rectangle (not shown in the figures). In certain embodiments, the pour spout 16 in the fitment 2 is centrally positioned within the stopper 8 so that the center axis of the pour spout 16 substantially coincides with the longitudinal axis of the stopper 8. In additional embodiments, however, the pour spout 16 in the fitment 2 is positioned toward one side of the stopper 8, as shown in FIGS. 4A-4D, such that the pour spout 16 extends through a section of the stopper 8 that is off the longitudinal axis of the stopper 8. In certain embodiments the pour spout 16 can be pre-formed in the stopper 8. In additional embodiments, the pour spout 16 can be created by the removal of a material, such as aluminum foil, from the stopper 8 by a consumer or user. In certain embodiments, such removal can be accomplished by providing perforations in the material forming the fitment 2 permitting the pour spout 16 when the perforations are forced open by depression. In alternative embodiments, the removal can comprise a pull tab or similar device allowing for removal of a detachable portion of the fitment 2 when manually grasped and pulled away from the fitment 2.

As previously described, one or more baffles 26 extending toward the interior chamber 20 of the container 6 may be connected to the bottom surface 34 of the stopper 8. It is noted, however, that in certain embodiments, the baffles 26 may also be connected to the sidewall 9 of the fitment, thereby avoiding direct connection with the stopper 9 itself, without departing from the scope of the claimed invention. These baffles 26 are configured to penetrate and direct the flow of powdered product 4, including clumps 12*a*, 12*b* and 12*c*, in the container 6 towards the pour spout 16 when the fitment 2 is located within the throat 30 of the container 6. The number and orientation of the one or more baffles 26 may be selected from any number of alternatives, depending, for example, on the potential sizes of the clumps 12*a*-12*f* in the powdered product 4, as well as the sizes and dimensions of the container 6 and the mouth 14 of the container 6. As contemplated herein, each baffle 26 may comprise a top, a bottom and sides. In practice, the tops of the one or more baffles 26 are connected to the bottom surface of the stopper 8 and the bottoms of each one of the one or more baffles 26 extend into the interior of the container 6. The sides of the one or more baffles 26 can be flat or rounded or comprise flat sections and rounded sections. The baffles 26 can vary in thickness and length, depending, for example, on the desired shape of the pour spout 16 in the fitment 2.

As shown in the example embodiments in FIGS. 4A-4D, 5A-5D and 6A-6H, the one or more baffles 26 can be irregularly shaped, having curved bottoms and/or straight bottoms. In certain embodiments, the baffles 26 may be formed such that each baffle 26 varies in thickness along its length such that one part of the baffle has a greater thickness than another part of the baffle. In the embodiment shown in FIGS. 4A-4D, the fitment 2 includes a single baffle 26, which is centrally located on the bottom surface of the stopper 8 and oriented so that it substantially bisects the area of the stopper 8 that is not taken up by the pour spout 16 of the stopper 8. FIGS. 5A-5D show an alternative embodiment of the fitment 2, which includes 3 baffles converging toward a single point at or near the proximal edge of the pour spout 16.

Figure 6A:
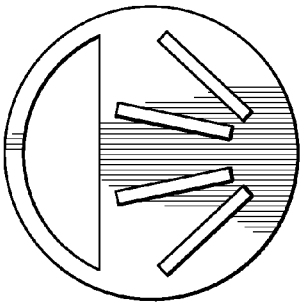
FIGS. 6A-6H show various views of still other examples of fitments according to additional embodiments of the present invention, wherein the fitment includes a plurality of baffles configured in a number of different sizes and orientations.
Figure 6C:
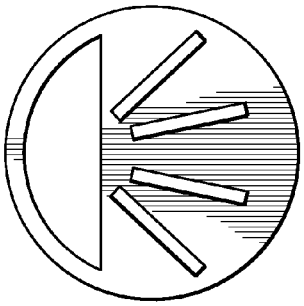
Figure 6B:
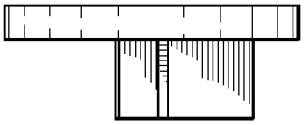
Figure 6D:
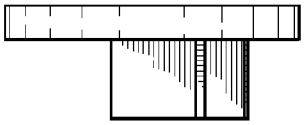
Figure 6E:
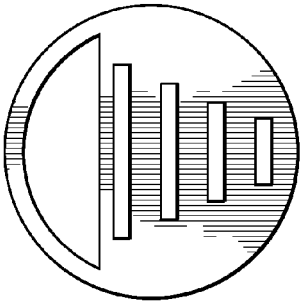
Figure 6G:
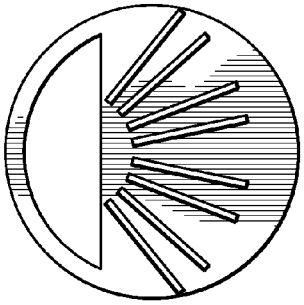
Figure 6F:
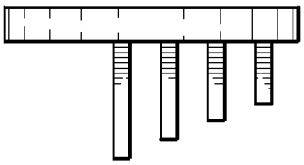
Figure 6H:
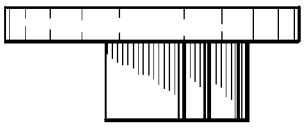

FIGS. 6A-6H show a variety of other potential orientations for the baffles 26 on the stopper 8. In certain embodiments, where the fitment 2 contains more than one baffle 26, the baffles 26 can be oriented such that they point towards the pour spout 16 formed in the stopper 8, as shown in FIGS. 6C, 6D, 6G and 6H. Alternatively, a fitment 2 with multiple baffles 26 may have baffles 26 oriented so that they converge at or near a point away from the pour spout 16 in the stopper 8, as shown in FIGS. 6A and 6B. In certain embodiments, the baffles 26 may have different lengths and may be oriented so that they are parallel to one edge of the pour spout 16, as shown in FIGS. 6E and 6F. The baffles 26 may have a greater thickness at a section of the baffles 26 proximal to the pour spout 16 in the stopper 8. In other embodiments (not shown), the baffles 26 may have a greater thickness at a section of the baffles 26 more distal to the pour spout 16 in the stopper 8.

Figure 7:
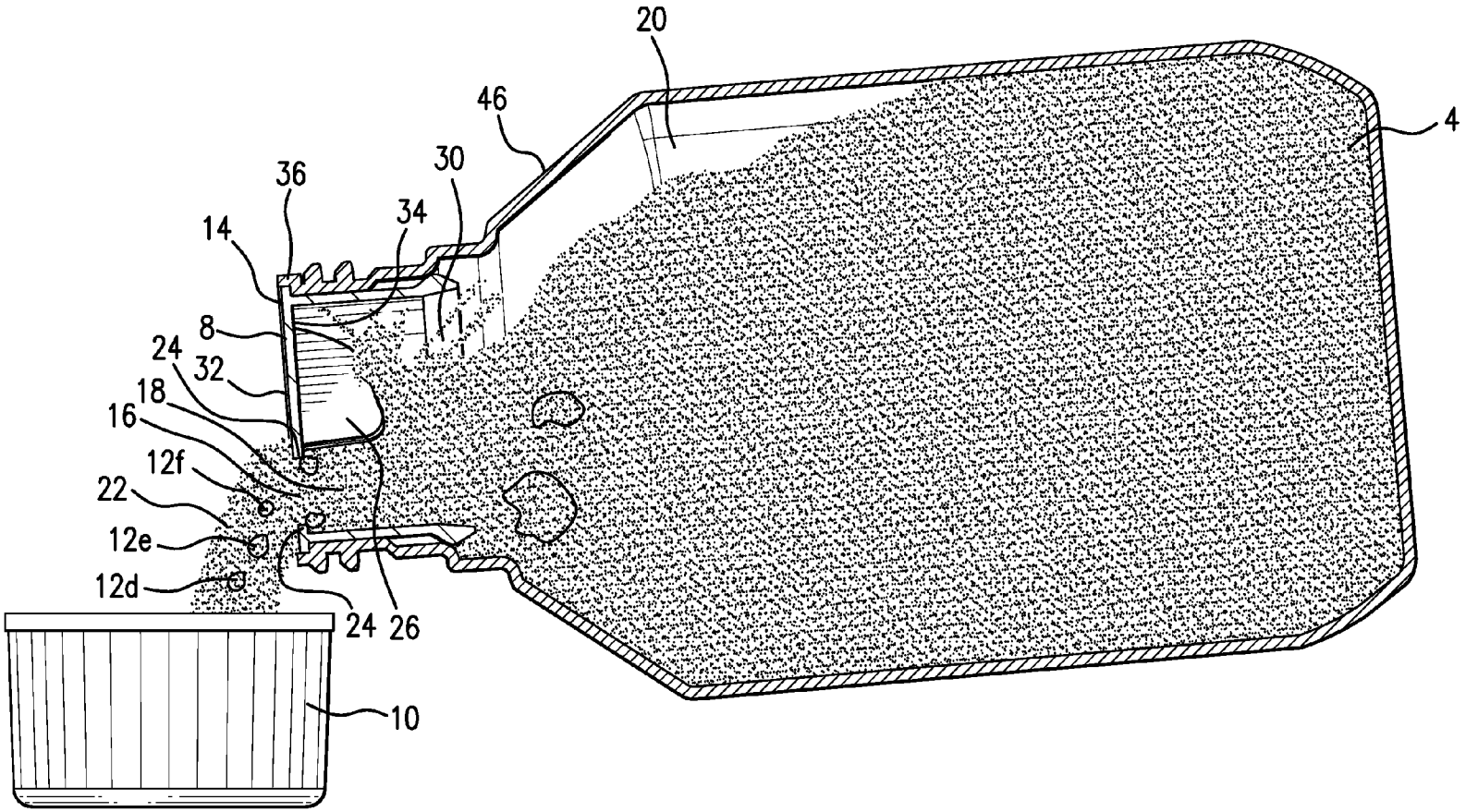
FIG. 7 shows a container configured according to still another implementation of the present invention.

FIG. 7 shows an alternative embodiment of the present invention. As shown in FIG. 7, the alternative embodiment provides a container 46, which may comprise a bottle, carton, box or pouch, for example, and includes a mouth 14, an interior chamber 20 to hold the powdered or granulated product 4, and a passageway 18 between the mouth 14 and the interior chamber 20. In some embodiments, the container 46 is constructed from glass or a petroleum-based polyethylene thermoplastic, such as high-density polyethylene (HDPE), low-density polyethylene (LDPE) or polyethylene terephthalate (PET). A stopper 8 is secured in a fixed position between the mouth 14 and the interior chamber 20, the stopper 8 having a top surface 32 facing the mouth 14 and a bottom surface 34 facing the interior chamber 20. The container 46 also includes a pour spout 16 in the stopper 8, which is configured to permit the powdered or granulated product 4 held in the interior chamber 20 to pass through the passageway 18 and out of the mouth 14 in a stream 22 when the container 46 is tilted toward the side of the stopper 8 having the pour spout 16. One or more baffles 26 are fixedly disposed on the bottom surface 34 of the stopper 8. The baffles 26 project into the interior chamber 20 side of the passageway 18 of the container 46 toward the portion of powdered or granulated product 4 as it enters the passageway 18. Notably, the shape, orientation and location of the one or more baffles 26, relative to the pour spout 16, causes at least a portion of the powdered product 4 moving toward the pour spout 16 to pass over and around the distal ends of at least one or more of the baffles 26 before the powdered product 4 passes entirely through the passageway 18 and into the pour spout 16. Thus, if there are any clumps of powdered or granulated product in the portion of the powdered product 4 passing over and around the baffles 26 in the passageway 18, those clumps will likely be broken apart by one or more of the baffles 26 prior to those clumps 12*a*-12*f* being able to reach the pour spout 16. Additionally, a restriction 24 is provided, which surrounds the pour spout 16 such that some of the clumps passing through the passageway 18 will strike the restriction 24 and will be broken apart by the restriction 24 before such clumps can pass into and through the pour spout 16. The combined actions of the baffles 26 extending from the stopper 8 and the restriction 24 surrounding or abutting the pour spout 16 operate to remove the majority of clumps in the powdered product 4 which could disrupt the consistent rate of flow and geometry of the stream 22 flowing through the mouth 14 of the container 46.

Although the exemplary embodiments, uses and advantages of the invention have been disclosed above with a certain degree of particularity, it will be apparent to those skilled in the art upon consideration of this specification and practice of the invention as disclosed herein that alterations and modifications can be made without departing from the spirit or the scope of the invention, which are intended to be limited only by the following claims and equivalents thereof.

What is claimed is:

1. A fitment for a container of powdered product prone to clumping behavior, the container having a mouth, an interior chamber, and a passageway between the mouth and the interior chamber, the fitment comprising:

(a) a stopper to close the passageway;

(b) a pour spout extending through the stopper to permit a portion of the powdered product in the interior chamber to flow through the passageway and out of the mouth of the container in a stream when the container is tilted in a pouring operation, the portion flowing through the passageway having one or more clumps of the powdered product, wherein the pour spout is positioned toward one side of the stopper such that the pour spout extends through a section of the stopper off a longitudinal axis of the stopper; and (c) a plurality of baffles connected to the stopper, the baffles extending toward the interior chamber of the container and arranged to penetrate said portion of the powdered product as said portion flows through the passageway, wherein the baffles are positioned toward an opposite side of the stopper (the baffle side) compared to the pour spout and wherein the baffle side does not contain any pour spout;

whereby, upon contact with the baffles, at least one of said one or more of the clumps in the portion of powdered product flowing into the passageway is broken apart by one or more of said plurality of baffles.

2. The fitment of claim 1, further comprising a restriction in the stopper configured to limit a volume of powdered product permitted to flow through the pour spout.

3. The fitment of claim 2, wherein:

the restriction is arranged to make contact with the volume of powdered product permitted to flow through the pour spout; and whereby, one or more clumps of powdered product in the volume of powdered product permitted to flow through the pour spout will be broken apart by contact with the restriction before flowing out of the mouth of the container.

4. The fitment of claim 1, wherein the pour spout comprises an asymmetric opening.

5. The fitment of claim 1, wherein the pour spout comprises a plurality of openings extending through the stopper.

6. The fitment of claim 1, wherein the plurality of baffles are oriented such that they point towards the pour spout.

7. A container for a powdered product prone to clumping behavior, comprising:

(a) an interior chamber to hold the powdered product;

(b) a mouth;

(c) a passageway between the interior chamber and the mouth;

(d) a stopper that closes the passageway;

(e) a pour spout extending through the stopper that permits a portion of the powdered product in the interior chamber to flow through the passageway and out of the mouth of the container in a stream when the container is tilted in a pouring operation, the portion flowing through the passageway having one or more clumps of the powdered product, wherein the pour spout is positioned toward one side of the stopper such that the pour spout extends through a section of the stopper off a longitudinal axis of the stopper; and (f) a plurality of baffles connected to the stopper, the baffles extending into the passageway and arranged to penetrate said portion of the powdered product as said portion flows through the passageway, wherein the baffles are positioned toward an opposite side of the stopper (the baffle side) compared to the pour spout and wherein the baffle side does not contain any pour spout;

whereby, upon contact with the baffles, at least one of said one or more clumps in the portion of powdered product flowing into the passageway is broken apart by one or more of said plurality of baffles.

8. The container of claim 7, further comprising a restriction to limit the volume of powdered product permitted to flow through the pour spout.

9. The container of claim 8, wherein:

the restriction is arranged to make contact with the volume of powdered product permitted to flow through the pour spout; and whereby, one or more clumps of powdered product in the volume of powdered product permitted to flow through the pour spout will be broken apart by contact with the restriction before flowing out of the mouth of the container.

10. The container of claim 7, wherein the pour spout comprises an asymmetric opening.

11. The container of claim 7, wherein the pour spout comprises a plurality of openings extending through the stopper.

12. The container of claim 7, wherein the plurality of baffles are oriented such that they point towards the pour spout.

* * * * *